US007347074B2

(12) United States Patent
Cattinori

(10) Patent No.: US 7,347,074 B2
(45) Date of Patent: Mar. 25, 2008

(54) DRAWBENCH OF A WIRE

(76) Inventor: Enrico Cattinori, Via Prati Alti, Gandosso (BG) (IT) 1-24060

( * ) Notice: Subject to any disclaimer, the term of this patent is extended or adjusted under 35 U.S.C. 154(b) by 82 days.

(21) Appl. No.: 11/300,231

(22) Filed: Dec. 14, 2005

(65) Prior Publication Data

US 2006/0123869 A1 Jun. 15, 2006

(30) Foreign Application Priority Data

Dec. 14, 2004 (EP) ..... 04029614

(51) Int. Cl.
*B21C 3/12* (2006.01)

(52) U.S. Cl. ..... 72/285

(58) Field of Classification Search ..... 72/285, 72/290, 291

See application file for complete search history.

(56) References Cited

U.S. PATENT DOCUMENTS 2,226,400 A * 12/1940 Gaines ..... 72/205
2,337,881 A * 12/1943 Gaines ..... 72/332
2,797,799 A * 7/1957 Ehlert ..... 72/316
3,031,068 A * 4/1962 Ware ..... 72/44
3,183,699 A * 5/1965 Ehlert ..... 72/161
3,184,943 A * 5/1965 Ware ..... 72/206
3,273,372 A 9/1966 Ehlert et al.
5,724,847 A 3/1998 Hite

FOREIGN PATENT DOCUMENTS

GB 1 169 231 A 10/1969

* cited by examiner

*Primary Examiner*—Daniel C Crane
(74) *Attorney, Agent, or Firm*—Akerman Senterfitt

(57) ABSTRACT

A drawbench (11, 111) of a wire (13), unwinding from a reel (14) and pulled step by step by an utilizing machine (15) of drawn wire, said drawbench (11, 111) having an unusually high productivity and comprising a drawing die (17) guided in a mobile manner on a frame (16), a device (18, 118) for moving said die (17) along a drawing stroke, rearming means (19) of said device (18, 118), said rearming means (19) comprising the die (17).

13 Claims, 3 Drawing Sheets

DRAWBENCH OF A WIRE

FIELD OF APPLICATION

The present invention, in its most general aspect, refers to a production line for screws, bolts and similar small metal articles, from a wire and that essentially comprises, in succession, a reel, on which said wire is wound, a drawbench and an utilizing machine of the drawn wire, for example a bolt moulding machine.

In particular, the present invention refers to a production line for small metal articles of the aforementioned type, in which the wire, unwound from the respective reel, is made to advance through the drawbench, pulled step by step by the utilizing machine of the drawn wire.

Even more specifically this invention concerns a drawbench of wire, which can be used for production lines for small metal articles of the aforementioned type, said wire unwinding from a reel and being pulled step by step by an utilizing machine of the drawn wire, said drawbench being of the type comprising a drawing die guided in a mobile manner on a frame, a device for moving said die along a drawing stroke and means for rearming said device.

PRIOR ART

It is known that for the production, for example, of bolts, screws and other similar small metal articles starting from metal wires, it is necessary for the predetermined wire to be calibrated and/or hardened on the surface in an appropriate manner, before proceeding to the actual forming of said articles like, for example, cutting into pieces of predetermined length, obtaining cylindrical, polygonal and similar heads, mechanical chip removal operations like turning, milling, threading and the like.

And it is known that, for such a purpose, the technology of subjecting the wire to drawing is advantageously applied.

In production lines of bolts, screws or other similar small metal articles starting from wires, drawbenches and in particular so-called mobile die drawbenches are consequently widely used, where the wire to be drawn is made to advance step by in step and the drawing of subsequent portions of wire is carried out by moving the drawing die on the wire held still.

In accordance with the aforementioned technology, the advance step by step of the wire is advantageously carried out by the same utilizing machine of the drawn wire, arranged downstream and in line with the mobile die drawbench.

In such a known drawbench it is therefore possible to identify a mobile die for drawing, guided in a mobile manner on a frame, a device for moving said die along a drawing stroke and rearming means of said device for a subsequent drawing stroke of the die. In general, in the prior art, taking into account that the die is constantly engaged on the wire to be drawn, the return of said die at the start of the drawing stroke takes place "automatically" each time the wire is pulled by the utilizing machine; consequently, in accordance with the prior art, in mobile die drawbenches, specific means for carrying out the aforementioned return of the die at the start of the drawing stroke are not provided.

In said machines, on the other hand, the device for moving the die comprises a cylinder-piston group with double action. The piston of the aforementioned group, starting from a starting condition, is commanded alternately to make the mobile die perform the drawing stroke and to return to said starting condition, respectively.

Although advantageous from various points of view, the known drawbench schematically described above has recognised drawbacks.

The most noticeable drawback is that the productivity of the drawbench is limited by the time used in the return stroke of the piston, a time that is relatively long.

The cylinder, indeed, having to be sized to provide the die with all of the energy necessary for the drawing operation, for a sufficient time to perform the entire drawing stroke, generally occupies considerable volumes. In order to fill such volumes with a fluid, relatively long times are required and this occurs both for the drawing stroke and for the return stroke, that is equal and opposite.

SUMMARY OF THE INVENTION

The technical problem underlying the present invention is that of devising and providing a mobile die drawbench of the type considered above, having structural and functional characteristics able to overcome, in a simple and cost-effective manner, the aforementioned drawbacks mentioned with reference to the prior art.

The technical solution idea of said problem is that of deactivating said device at the end of each drawing stroke and carrying out the rearming thereof interlocking it with the drawing die during the return thereof at the start of the drawing stroke.

Based upon this solution idea, the problem outlined above is solved, according to the present invention, by a mobile die drawbench of the type considered above characterised in that said rearming means of said device comprise the die.

Further characteristics and advantages of the drawbench according to the present invention shall become clearer from the following description of a preferred embodiment thereof, provided for indicating and not limiting purposes with reference to the attached drawings.

DETAILED DESCRIPTION OF A PREFERRED EMBODIMENT

Figure 1:
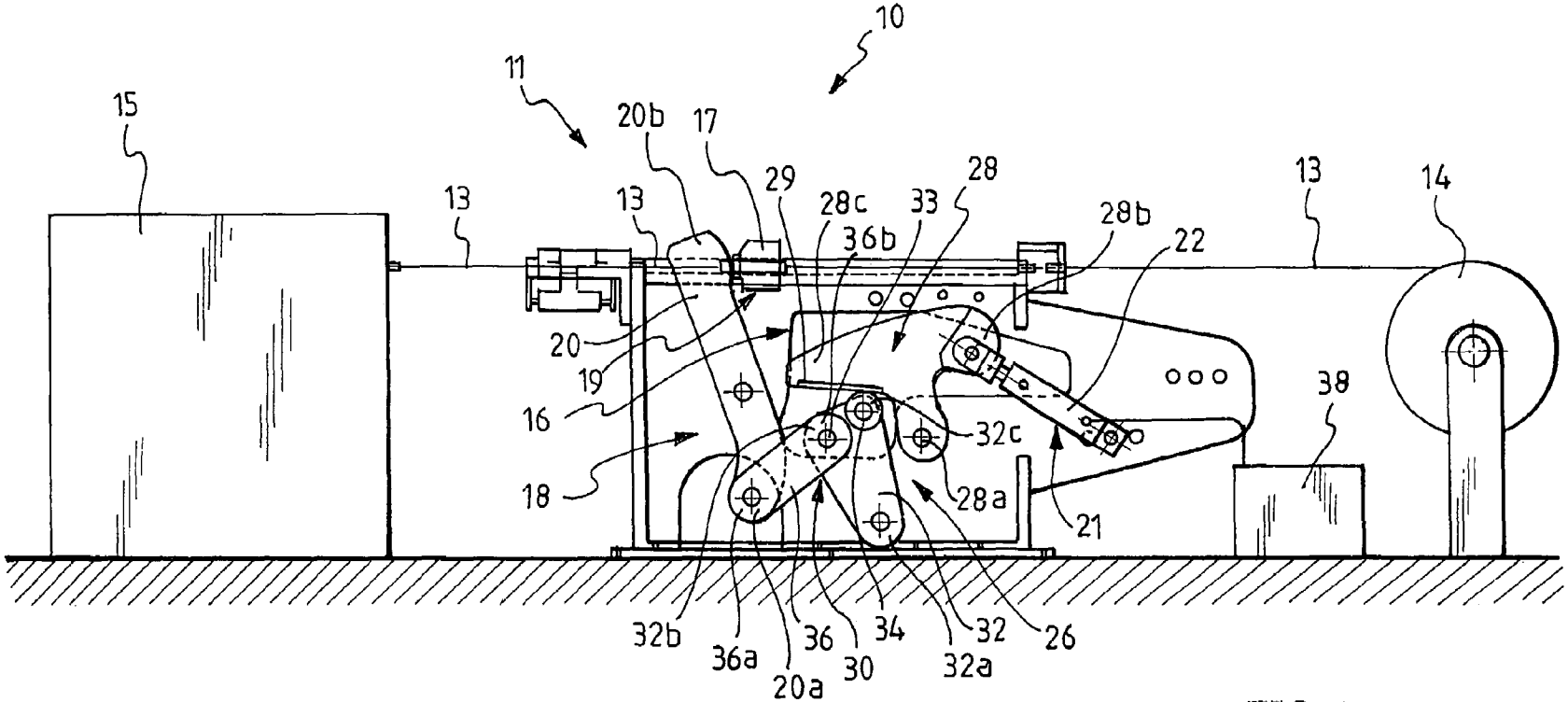
FIG. 1 schematically represents a side view of a production line of screws, bolts and similar small metal articles, comprising a drawbench of a wire according to the present invention.

With initial reference to FIG. 1, a production line of screws, bolts and similar small metal articles, globally indicated with 10, comprising a drawbench 11, in accordance with the present invention, of a wire 13, is shown. The wire 13 is unwound from a reel 14 and is pulled step by step by an utilizing machine 15 of drawn wire.

Figure 2:
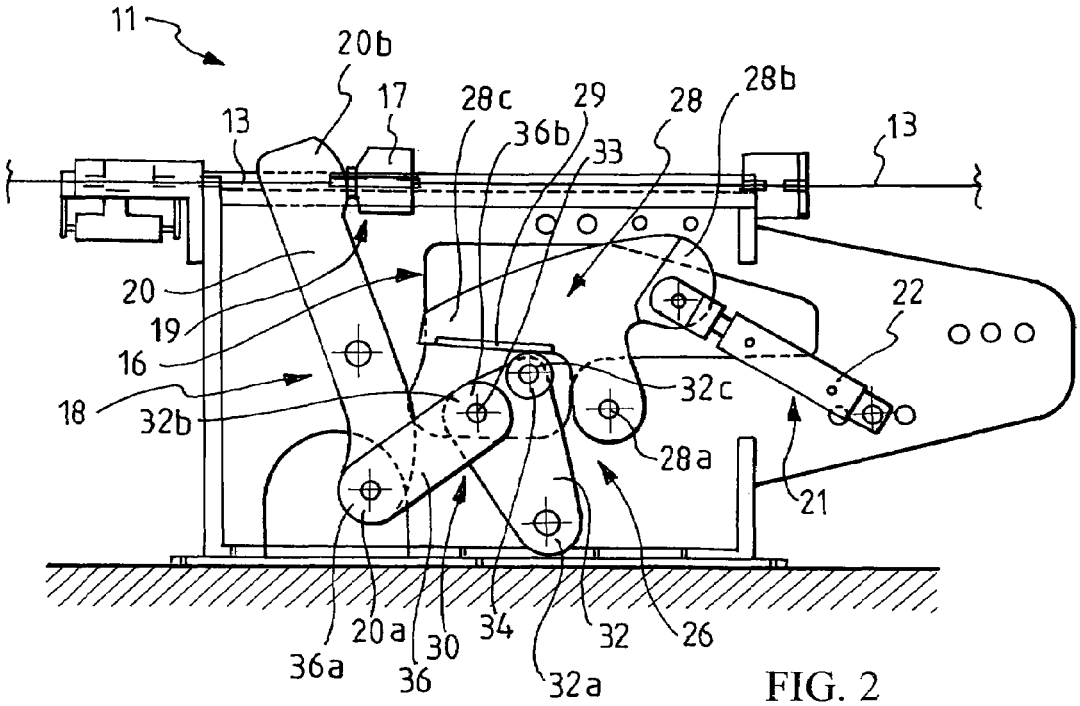
FIG. 2 schematically represents an enlarged side view of a detail of the line of FIG. 1, and specifically of the drawbench according to the invention.
Figure 3:
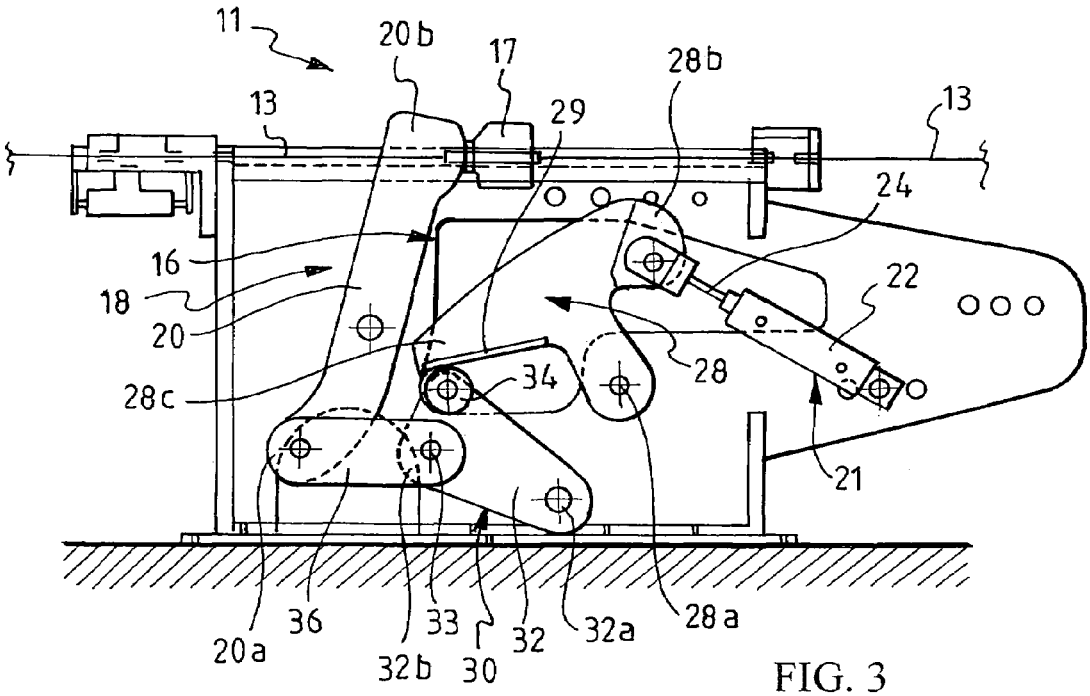
FIG. 3 schematically represents a side view of the drawbench of FIG. 2, in a different operating position.

The drawbench 11, which is shown enlarged in FIGS. 2 and 3, is of the type comprising a drawing die 17 guided in a mobile manner on a frame 16, a device 18 for moving said die 17 along a drawing stroke and rearming means 19 of said device 18.

In accordance with an aspect of the present invention, said rearming means 19 of said device 18 comprise the die 17.

More specifically, the device 18 comprises a lever 20 of the first type and a cylinder 22 and piston 24 group 21, the cylinder 21 being arranged in a predetermined position of the frame 16.

The lever 20 is pivoted in the frame 16 and has an end 20*a* subjected to the action of the cylinder 22 and piston 24 group 21 and an opposite end 20*b* acting on the die 17 to move it along the wire 13 in the drawing stroke, away from the utilizing machine 15, along a work axis X-X of the drawbench 11.

Preferably, the device 18, which is substantially below the work axis X-X of the drawbench 11, also comprises a mechanical transmission 26, which is placed between said group 21 and said lever 20. This mechanical transmission 26 is preferably a movement amplification transmission.

The transmission 26 comprises an equalizer 28 and a toggle 30.

The equalizer 28 has a pivot 28*a*, in a predetermined position of the frame 16, and two opposite arms 28*b* and 28*c*. More specifically, the pivot 28*a* and the ends of the two arms 28*b* and 28*c* have a triangular arrangement, the ends of the two arms 28*b* and 28*c* being situated substantially above the pivot 28*a*.

The equalizer 28 has a first arm 28*b* with fixed operative length and a second arm 28*c* with variable operative length. This is made concrete by the fact that the first arm 28*b* is rotatably connected to the piston 24, whereas the second arm 28*c* is equipped with a guide 29 for a ball bearing.

The toggle 30 comprises two members 32 and 36 rotatably connected to each other by a hinge 33.

The first member 32, substantially triangular in shape, is rotatably connected to the drawbench 11 substantially close to a first vertex thereof 32*a*, in a predetermined position of the frame 16. The hinge 33 is provided substantially close to a second vertex 32*b*: close to the third vertex 32*c*, on the first member 32 a ball bearing 34 is mounted, suitable for sliding along the guide 29 of the equalizer 28. More specifically, the ball bearing 34 is substantially above the vertices 32*a* and 32*b*.

The second member 36, substantially of elongated shape, is rotatably connected, at one of its ends 36*a*, to said end 20*a* of the lever 20. At the opposite end 36*b* of said second member 36, said hinge 33 is provided.

It should be noted that, in the example of the figures, the cylinder 22 is mounted with the axis incident to the work axis X-X of the drawbench 11. The group 21 is preferably of hydraulic type and is actuated by a hydraulic control unit 38.

The operation of the drawbench 11 according to the invention is specified hereafter.

FIG. 2 shows the piston 24 at lower end stop. In such a situation, the die 17 is at start of the drawing stroke.

More specifically, the ball bearing 34, housed in the guide 29 of the equalizer 28, is in the end of the guide 29 of the second arm 28*c* of the equalizer 28 that is at the side of the pivot 28*a*. Consequently, the toggle 30 has the two members 32 and 36 arranged substantially bent.

The hydraulic control unit 38 supplies pressurised oil into the cylinder 22 until the piston 24 reaches the upper end stop position.

The die 17 thus performs the drawing stroke, until it is at the end of the drawing stroke, shown in FIG. 3.

In such a situation, more specifically, the ball bearing 34, that, as stated, is able to slide in the guide 29 of the equalizer 28, ends up in the end of the guide 29 of the second arm 28*c* of the equalizer 28 that is at the opposite side to the pivot 28*a*. Consequently, the toggle 30 ends up having the two members 32 and 36 arranged substantially extended.

The utilizing machine 15 at this point substantially pulls back the portion of wire 13 that has been drawn. Such a supply step of the utilizing machine 15 takes place having short-circuited the chambers of the cylinder 22, or having placed them in communication with atmospheric pressure: in such a way, the return action of the wire 13 by the utilizing machine 15, as well as taking the die 17 back to the start of the drawing stroke, makes the oil flow back from the cylinder 22 to the hydraulic control unit 38. Thus the pulling back of the utilizing machine 15 also carries out the rearming of the device 18.

Figure 4:
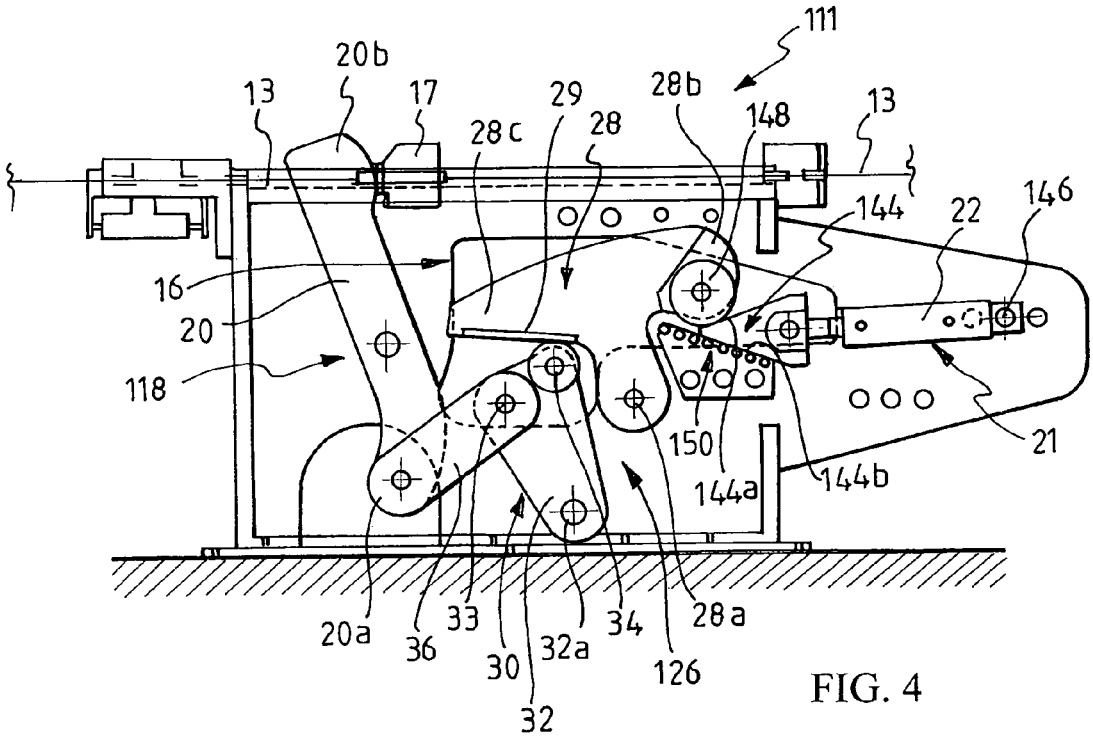
FIG. 4 schematically represents a side view of another embodiment of a drawbench of wire, according to the present invention.
Figure 5:
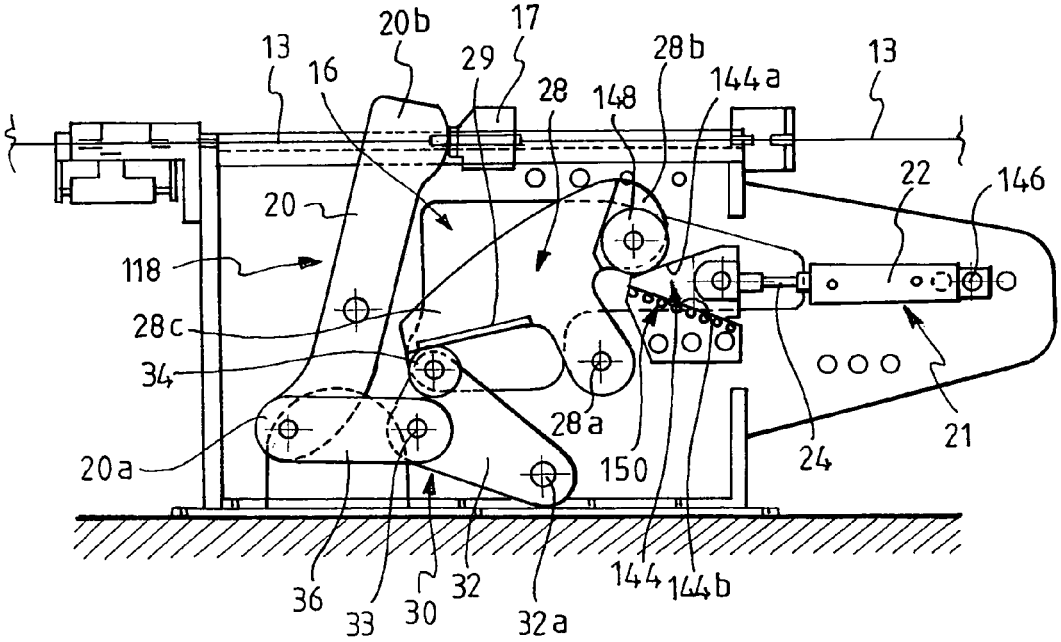
FIG. 5 schematically represents a side view of the drawbench of FIG. 4, in a different operating position.

With reference to FIGS. 4 and 5, a second embodiment of a drawbench, in accordance with the present invention and globally indicated with 111, of a wire 13 is shown. In said figures, the elements that are structurally and functionally analogous with respect to those of the drawbench 11 are indicated with the same reference numeral and the detailed description of these is not repeated.

In this embodiment, the drawbench 111 is equipped with a device 118 comprising a mechanical transmission 126 that includes, as well as the equalizer 28 and the toggle 30, also a member 144. The member 144 has two sides 144*a* and 144*b* arranged like a wedge and is arranged between the group 21 and the equalizer 28.

More specifically, the member 144 is fixed to the piston 24. The cylinder 22 is rotatably connected to the drawbench 111 thanks to a pin 146, preferably provided at the base of the cylinder 22.

The upper side 144*a* of the member 144 engages with a ball bearing 148, mounted on the first arm 28*b* of the equalizer 28 (where, in the previous embodiment of the invention, on the other hand, the piston 24 was rotatably connected).

The opposite lower side 144*b* of the member 144 is able to slide on an inclined roller table 150, preferably arranged in a converging manner with respect to the work axis X-X.

The operation of the drawbench 111 is totally similar to the operation of the drawbench 11 and at this point it is sufficient to recall the following.

FIG. 3 shows the piston 24 at the lower end stop. In such a situation, the die 17 is at the start of the drawing stroke.

The hydraulic control unit 38 supplies pressurised oil into the cylinder 22 until the piston 24 reaches the upper end stop position.

The die 17 thus performs the drawing stroke, until it is at the end of the drawing stroke, shown in FIG. 4.

More specifically, when the piston 24 advances, the ball bearing 148 is moved upwards from the upper side 144*a* of the member 144, such a member 144 advancing on the inclined roller table 150.

It should be noted that the present invention also concerns a device for moving a drawing die of a drawbench of a wire, structured in the ways described above, and respectively indicated with 18 and with 118.

From the previous description it can clearly be seen that the drawbench of a wire, according to the invention, solves the technical problem and achieves numerous advantages the first of which lies in the fact that unusually high productivity is obtained, thanks to the fact that the idle times, linked to the rearming of the device that is used to move the die are avoided, i.e. the idle times are hidden.

Another advantage of the present invention is that the device for moving the die of the drawbench has excellent adaptability to the different types of drawbench and consequently, separately commercialised, can easily be used for revamping existing drawbenches.

Moreover, according to the invention, through the association of the equalizer with variable operating length and of the toggle, a substantially constant drawing speed of the die is surprisingly obtained.

A further big advantage is the fact that the drawbench according to the invention practically does not need to be adjusted according to the different types of produced pieces:

indeed, it is the utilizing machine arranged downstream of the drawbench that, thanks to the mechanical transmission in retrograde motion according to the invention, takes the die, and the device for moving the die itself, automatically back in the configuration of the start of processing, for each subsequent drawing stroke of the wire. This means that the device for moving the die is rearmed automatically for the portion necessary for the subsequent drawing stroke, which can be a different length to the previous one according to the piece produced in the utilizing machine: in this way, with the invention the use of mechanical stops according to the prior art, which had to be adjusted by an operator whenever the type of production was varied, is avoided.

Of course, a man skilled in the art can make numerous modifications and variants to the drawbench described above in order to satisfy specific and contingent requirements, all of which are in any case covered by the scope of protection of the present invention as defined by the following claims.

The invention claimed is:

1. A drawbench for a wire unwound from a reel and pulled step by step by a utilizing machine, said drawbench comprising:

a drawing die guided in a mobile manner on a frame;

a device for moving said die along a drawing stroke, wherein said device comprises a lever, a cylinder and piston group, and a mechanical transmission; and rearming means of said device, wherein said die comprises the rearming means, wherein said mechanical transmission is a movement amplification transmission, and wherein said mechanical transmission comprises a toggle, in turn comprising a first member and a second member rotatably connected to each other by a hinge.

2. The drawbench according to claim 1, wherein said lever is of a first type and is pivoted in the frame, having one end subjected to the action of the cylinder and piston group, and having an opposite end acting on the die to move it along the wire in the drawing stroke, away from the utilizing machine.

3. The drawbench according to claim 1, wherein said first member is substantially triangular in shape and is rotatably connected to the drawbench substantially close to a first vertex thereof, in a predetermined position of the frame; wherein said hinge is provided substantially close to a second vertex of said first member, close to the third vertex thereof, said ball bearing being suitable for sliding along a guide comprised in the mechanical transmission.

4. The drawbench according to claim 1, wherein said second member is substantially elongated in shape, and is rotatably connected, at one end thereof, to said end of the lever, said hinge being provided at the opposite end of said second member.

5. The drawbench according to claim 1, wherein the group is actuated by a hydraulic control unit.

6. The drawbench according to claim 1, wherein said cylinder has chambers that can be short-circuited in the return stroke of the die.

7. A drawbench for a wire unwound from a reel and pulled step by step by a utilizing machine, said drawbench comprising:

a drawing die guided in a mobile manner on a frame;

a device for moving said die along a drawing stroke, wherein said device comprises a lever, a cylinder and piston group, and a mechanical transmission; and rearming means of said device, wherein said die comprises the rearming means, wherein said mechanical transmission is a movement amplification transmission, and wherein said mechanical transmission comprises an equalizer having a pivot in a predetermined position of the frame and two opposite arms.

8. The drawbench according to claim 7, wherein said pivot and the ends of the two arms have a triangular arrangement, said equalizer having a first arm with fixed operative length and a second arm with variable operative length.

9. The drawbench according to claim 8, wherein said first arm is rotatably connected to the piston, whereas the second arm is equipped with a guide for a ball bearing.

10. The drawbench according to claim 7, wherein said mechanical transmission comprises a wedge-shaped member having two sides arranged like a wedge, said wedge-shaped member being arranged between the group and the equalizer.

11. The drawbench according to claim 10, wherein said wedge-shaped member is fixed to the piston, the cylinder being rotatably connected to the drawbench thanks to a pin.

12. The drawbench according to claim 11, wherein one side of the wedge-shaped member engages with a ball bearing, mounted on the first arm of the equalizer, the opposite side of the wedge-shaped member being able to slide on a roller table.

13. A drawbench for a wire unwound from a reel and pulled step by step by a utilizing machine, said drawbench comprising:

a drawing die guided in a mobile manner on a frame;

a device for moving said die along a drawing stroke, wherein said device comprises a lever, a cylinder and piston group, and a mechanical transmission; and rearming means of said device, wherein said die comprises the rearming means, wherein said mechanical transmission is a movement amplification transmission, and wherein said mechanical transmission comprises a toggle, in turn comprising a first member and a second member rotatably connected to each other by a hinge, wherein said first member is substantially triangular in shape and is rotatably connected to the drawbench substantially close to the first vertex thereof, in a predetermined position of the frame, said hinge provided substantially close to a second vertex of said first member, and wherein a ball bearing is mounted on said first member, close to a third vertex thereof, said ball bearing being suitable for sliding along a guide comprised in the mechanical transmission, wherein said mechanical transmission further comprises an equalizer having a pivot in a predetermined position of the frame, a first arm with fixed operative length and a second arm with variable operative length, wherein said first arm is rotatably connected to the piston and the second arm is equipped with a guide for the ball bearing;

wherein said guide of said second arm of said equalizer houses said ball bearing of said first member of said toggle.

* * * * *